US007051644B2

(12) United States Patent
Park

(10) Patent No.: US 7,051,644 B2
(45) Date of Patent: May 30, 2006

(54) MOUNTING STRUCTURE OF PISTON PIN FOR HERMETIC COMPRESSOR

(75) Inventor: Jae-Sang Park, Busan (KR)

(73) Assignee: LG Electronics Inc., Seoul (KR)

( * ) Notice: Subject to any disclaimer, the term of this patent is extended or adjusted under 35 U.S.C. 154(b) by 126 days.

(21) Appl. No.: 10/433,366

(22) PCT Filed: Nov. 26, 2001

(86) PCT No.: PCT/KR01/02032

§ 371 (c)(1),
(2), (4) Date: Jun. 4, 2003

(87) PCT Pub. No.: WO02/46614

PCT Pub. Date: Jun. 13, 2002

(65) Prior Publication Data

US 2004/0025685 A1 Feb. 12, 2004

(30) Foreign Application Priority Data

Dec. 8, 2000 (KR) ..... 2000-74825

(51) Int. Cl.
*F16J 1/14* (2006.01)

(52) U.S. Cl. ..... 92/187

(58) Field of Classification Search ..... 92/187, 92/208

See application file for complete search history.

(56) References Cited

U.S. PATENT DOCUMENTS

| | | | | |
|---|---|---|---|---|
| 4,095,513 | A * | 6/1978 | Block | 92/187 |
| 6,276,260 | B1 * | 8/2001 | Bianchi | 92/187 |
| 6,588,319 | B1 * | 7/2003 | Maganhoto | 92/187 |

FOREIGN PATENT DOCUMENTS

| | | |
|---|---|---|
| JP | 62294784 A | 12/1987 |
| JP | 03121280 A | 5/1991 |
| KR | 1988-22049 | 12/1988 |

* cited by examiner

*Primary Examiner*—Edward K. Look
*Assistant Examiner*—Michael Leslie
(74) *Attorney, Agent, or Firm*—Fleshner & Kim, LLP

(57) ABSTRACT

A mounting structure for a piston pin of a hermetic compressor is provided. A connecting chamber formed at an end of the piston allows the piston to be connected to a crankshaft via a connecting rod. Caulking portions provided at upper and lower ends of the connecting chamber receive and hold the piston pin, thus engaging the piston, piston pin, connecting rod, and crankshaft. An interference preventive portion formed adjacent the connecting chamber prevents interference between the piston and the connecting rod when the components are so engaged. Because a separate structure within the piston receives and holds the piston pin, an outer diameter and/or cross section of the piston is not altered during the assembly process, thus improving system reliability and performance.

26 Claims, 3 Drawing Sheets

MOUNTING STRUCTURE OF PISTON PIN FOR HERMETIC COMPRESSOR

TECHNICAL FIELD

The present invention relates to a hermetic compressor, and more particularly, to a structure for mounting a piston pin, which connects a piston with a connecting rod for transforming a rotational motion of a crankshaft into a linear reciprocating motion of the piston, to the piston.

BACKGROUND ART

The interior constitution of a connecting rod type of hermetic compressor according to the prior art is shown in FIG. 1. Referring to this figure, an airtight container 1 composed of an upper container 1*t* and a lower container 1*b* is provided, and a frame 2 is installed within the airtight container 1. A stator 3 is fixed to the frame 2 which is in turn supported in the airtight container 1 by a spring 2S.

Further, a crankshaft 5 is installed through a central portion of the frame 2. The crankshaft 5 is integrally provided with a rotor 4, and thus, is rotated together with the rotor 4 by means of electromagnetic interaction with the stator 3.

At an upper end of the crankshaft 5, an eccentric pin 5*b* is formed to be offset from a center of rotation of the crankshaft 5. In addition, a counterweight 5*c* is formed at a side opposite to the eccentric pin 5*b*. At a lower end of the crankshaft 5, a propeller 5*d* for sucking up oil L residing at the bottom of the lower container 1*b* into an oil passage 5*a* formed through the crankshaft 5 is installed.

Furthermore, a cylinder 6 with a compression chamber 6' formed therein is integrally formed in the frame 2. Further, a piston 7, which is connected to the eccentric pin 5*b* of the crankshaft 5 through a connecting rod 8, is installed in the compression chamber 6'.

Here, as shown in FIG. 2, the eccentric pin 5*b* is connected to a crankshaft connecting portion 8*a* of the connecting rod 8, and the piston 7 is connected to a piston connecting portion 8*b* of the connecting rod 8 through a piston pin 7'. A sleeve SL is press-fitted between the crankshaft connecting portion 8*a* and the eccentric pin 5*b*. At this time, an external surface of the sleeve SL is pressed by an inner surface of the crankshaft connecting portion 8*a* so that the sleeve SL is rotated integrally with the connecting rod 8. The piston pin 7' is connected to the piston connection portion 8*b* in a state where it is press-fitted into the piston 7.

In addition, a valve assembly 9 for regulating a refrigerant introduced into and/or discharged from the compression chamber 6' is installed at a leading end of the cylinder 6. The reference numeral 10 denotes a head cover, the reference numeral 11 denotes a suction muffler, the reference numeral 12 denotes a suction pipe for transferring the refrigerant into the airtight container 1, and the reference numeral 13 denotes a discharge pipe for discharging the refrigerant to the outside of the compressor.

In the compressor constructed as such, when electric power is applied to the compressor, the rotor 4 is rotated by means of the electromagnetic interaction between the stator 3 and the rotor 4. Simultaneously, the crankshaft 5 is rotated integrally with the rotor 4. As the crankshaft 5 is rotated, the eccentric pin 5*b* offset from the crankshaft 5 revolves on an axis of the crankshaft 5. The connecting rod 8 connected to the eccentric pin 5*b* is interlocked with the eccentric pin 5*b* to cause the piston 7 to reciprocate linearly. Thus, the piston 7 causes the refrigerant to be compressed while reciprocating linearly within the compression chamber 6'.

However, there is the following problem in the prior art mentioned above.

In general, the relationship among the connecting rod 8, the piston 7 and the piston pin 7' is as follows. The piston pin 7' is press-fitted into the piston 7, and the connecting rod 8 and the piston pin 7' can be slid with each other. Therefore, the piston pin 7' is integrally fixed to the piston 7 and performs relative motion with respect to the piston connecting portion 8*b* of the connecting rod 8.

In order to produce the above motion, the piston pin 7' should be press-fitted into the piston 7. However, as shown well in FIG. 3, the piston 7 is somewhat distorted in a vertical direction in this figure as the piston pin 7' is press-fitted into the piston 7. Thus, a cross sectional shape of the piston does not become a perfect circle. It is a phenomenon that occurs because the piston pin 7' is forcibly press-fitted into the piston 7.

If the piston 7 is distorted and its section does not take the shape of the perfect circle, the phenomenon occurs that uneven wear is produced on an inner wall surface of the compression chamber 6' on which the piston 7 slides and the refrigerant leaks out between the inner wall surface of the compression chamber 6' and the piston 7. Thus, compression of the refrigerant within the compression chamber 6' cannot be properly made.

DISCLOSURE OF INVENTION

Accordingly, the present invention is contemplated to solve the problem in the prior art. An object of the present invention is to prevent deformation of a piston which may be produced upon connection between a connecting rod and the piston.

Another object of the present invention is to simplify an operation of connecting the connecting rod and the piston.

According to an aspect of the present invention for achieving the above objects, there is provided a mounting structure of a piston pin for a hermetic compressor, which comprises a connecting rod connected to a rotating crankshaft; a piston which linearly reciprocates by means of a rotational motion of the crankshaft transferred through the connecting rod and is formed such that a connecting chamber with the connecting rod positioned therein is opened toward a trailing end thereof; a piston pin connected to the piston within the connecting chamber in a state where it is slidably connected to the connecting rod; and caulking portions which are formed in the connecting chamber and are subjected to plastic deformation to encircle an external surface of the piston pin in order to fix the piston pin into the piston.

Preferably, the caulking portions may be formed to protrude from the piston within the connecting chamber and be provided in at least one of the locations corresponding to upper and lower ends of the piston pin.

Further, the caulking portions may be preferably formed to pair off into couples and be caulked to come into close contact with the external surface of the piston pin to fix the piston pin into the piston.

Furthermore, an interference preventive portion in which an end portion of the connecting rod slidably connected to the piston pin between the caulking portions is slidably secured may be provided in the connecting chamber.

According to the present invention constructed as such, there is an advantage in that deformation on the piston can be avoided upon fixing of the connecting rod for connecting the connecting rod and the piston.

BEST MODE FOR CARRYING OUT THE INVENTION

Hereinafter, a preferred embodiment of a mounting structure of a piston pin for a hermetic compressor according to the present invention will be described in detail with reference to the accompanying drawings.

Figure 1:
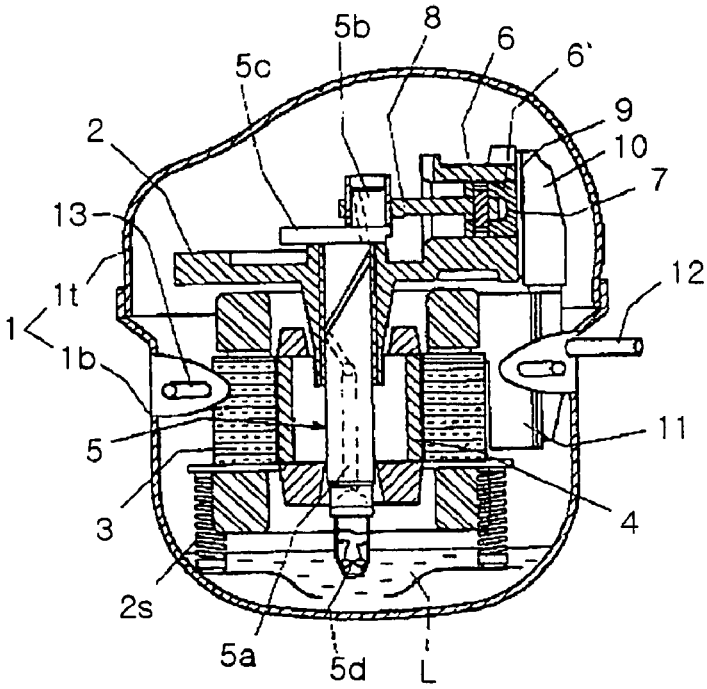
FIG. 1 is a sectional view showing the inner constitution of a general hermetic compressor.
Figure 2:
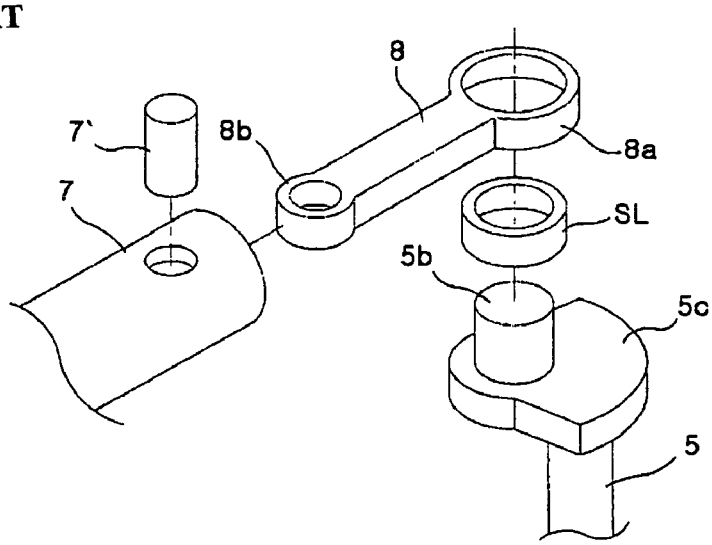
FIG. 2 PRIOR ART
FIG. 2 is an exploded perspective view showing the constitution of a connecting rod in a hermetic compressor according to the prior art.
Figure 3:
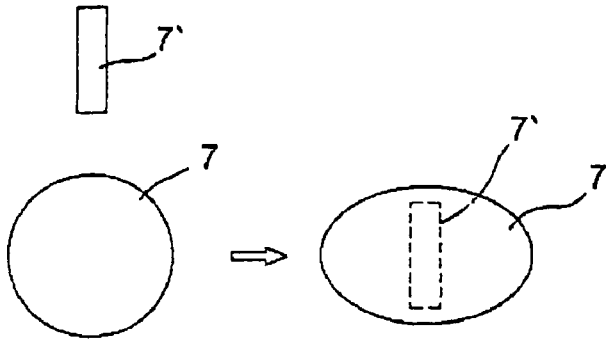
FIG. 3 PRIOR ART
FIG. 3 is an explanatory view illustrating a problem of the prior art occurring upon connection between a piston and the connecting rod.
Figure 4:
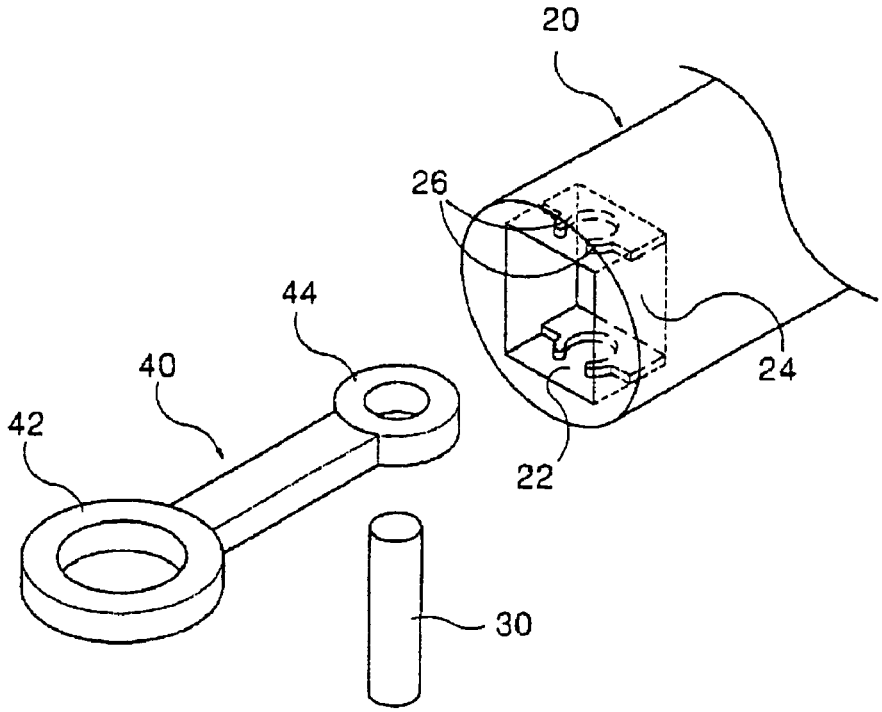
FIG. 4 is a partial cut-away exploded perspective view showing the constitution of a preferred embodiment of a mounting structure of a piston pin for a hermetic compressor according to the present invention.
Figure 5:
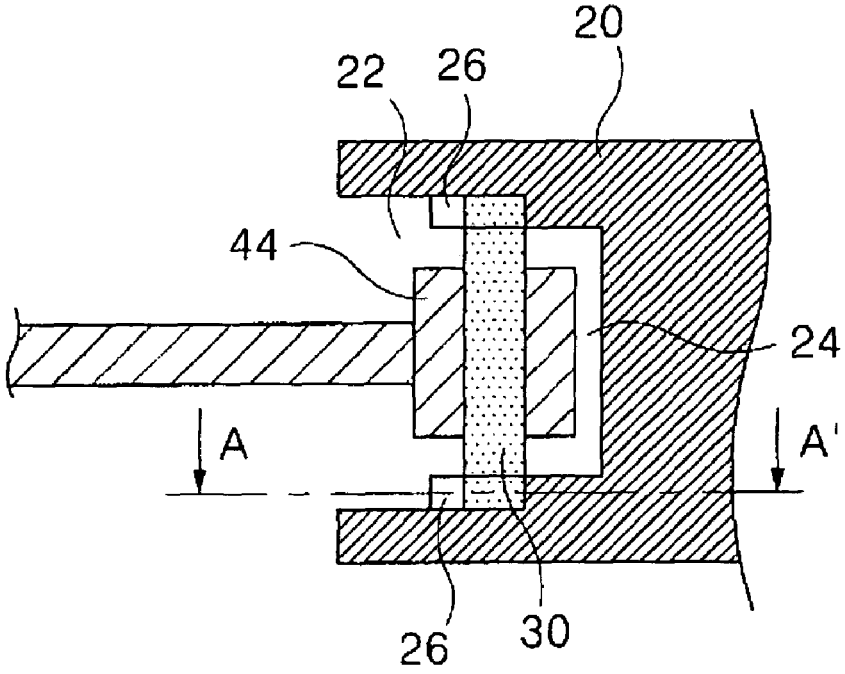
FIG. 5 is a sectional view showing the constitution of the preferred embodiment of the present invention.
Figure 6:
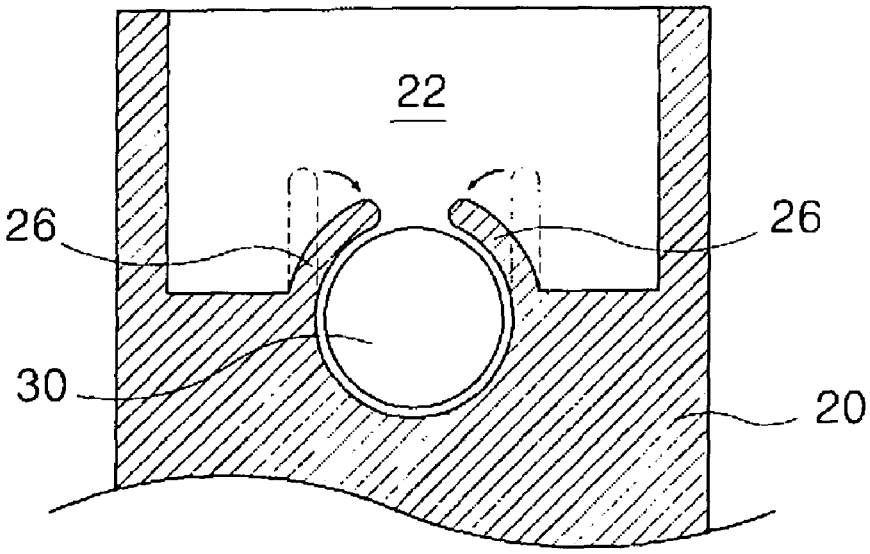
FIG. 6 is a sectional view taken along line A–A' of FIG. 5 and showing the constitution of essential components of the preferred embodiment of the present invention.

FIG. 4 is a partial cut-away exploded perspective view showing the constitution of the preferred embodiment of the mounting structure of the piston pin for the hermetic compressor according to the present invention, FIG. 5 is a sectional view showing the constitution of the preferred embodiment of the present invention, and FIG. 6 is a sectional view taken along line A–A' of FIG. 5.

As shown in these figures, a piston 20 for reciprocating linearly within a compression chamber 6' is manufactured in the form of a cylinder. In a trailing end of the piston 20, a connecting chamber 22 is formed to be opened toward the rear of the piston 20. The connecting chamber 22 is a portion where a connecting rod 40 is connected to the piston 20. An interference preventive portion 24 for avoiding interference between the piston and a piston connecting portion 44 of the connecting rod 40 is formed in the connecting chamber 22. The interference preventive portion 24 is a recess formed in the connecting chamber 22, in which an end of the piston connecting portion 44 is positioned.

Caulking portions 26, to be described later, for fixing a piston pin 30 into the piston 20 are formed at the top and bottom of the interference preventive portion 24 in the connecting chamber 22. The caulking portions 26 is a part for fastening the piston pin 30 through their own plastic deformation, and are initially formed to extend toward an opening of the connecting chamber 22 as shown in a dotted line in FIG. 6. Thereafter, when the piston pin 30 is fastened into the connecting chamber 22, the caulking portions 26 are subjected to the plastic deformation through the caulking operation and then come into close contact with an external surface of the piston pin 30 as shown in a solid line in FIG. 6.

The caulking portions 26 are formed to pair off into couples, and are made such that a spacing between themselves is equal to or slightly larger than a diameter of the piston pin 30 upon manufacture of the piston 20. The caulking portions 26 do not necessarily have to be formed at positions corresponding to upper and lower ends of the piston pin 30. That is, the caulking portions 26 may be formed wherever the piston pin 30 is properly fastened.

The piston pin 30 is fixed within the connecting chamber 22 of the piston 20 by means of the caulking portions 26, and causes the connecting rod 40 and the piston 20 to be connected with each other. At this time, the piston pin 30 is fastened to the piston by means of the caulking portions 26, and slidably connected with the connecting rod 40.

Furthermore, there is provided the connecting rod 40 of which an end is connected to the crankshaft 5 and of which the other end is connected to the piston 20. The connecting rod 40 connects the crankshaft 5 to the piston 20, and transforms a rotational motion of the crankshaft 5 into a linear reciprocating motion of the piston 20. The connecting rod 40 is provided with a crankshaft connecting portion 42 for connection with the crankshaft 5 formed at the end thereof and a piston connecting portion 44 for connection with the piston 20 formed the other end thereof Hereinafter, an operation of the mounting structure of the piston pin for the hermetic compressor according to the present invention constructed as such will be explained.

The piston 20 is generally formed through a sintering process. Thus, since the connecting chamber 22, the interference preventive portion 24, the caulking portions 26, and the like are simultaneously manufactured during the sintering process, they need not be subjected to additional machining processes.

That is, the connecting rod 40 is connected to the piston 20 merely by inserting the connecting rod 40 with the piston pin 30 inserted into the piston connecting portion 44 thereof from the trailing end of the piston 20 into the connecting chamber 22.

Then, the caulking portions 26 are subjected to the plastic deformation to encircle the upper and lower external surfaces of the piston pin 30. Consequently, the piston pin 30 is fixed to the piston 20, and can slide with respect to the piston connecting portion 44.

That is, in the process of fastening the piston pin 30 into the piston 20, the caulking portions 26, which have been formed to protrude within the connecting chamber 22, are merely subjected to the plastic deformation into a state where they can encircle the piston pin. Thus, the connection between the piston and the piston pin can be made without any influence on the external shape of the piston 20.

INDUSTRIAL APPLICABILITY

According to the mounting structure of the piston pin for the hermetic compressor of the present invention as specifically described above, since upon connection between the piston and the connecting rod, only the caulking portions are merely subjected to the plastic deformation to fix the piston pin into the piston, the shape deformation of the piston cannot be produced. Therefore, there is an advantage in that defective proportion in the process of assembling the piston can be minimized.

EXPLANATION OF REFERENCE NUMERALS TO MAJOR ELEMENTS IN THE DRAWINGS

1: Airtight container
**1*b***: Lower container
**1*t***: Upper container
2: Frame
3: Stator
4: Rotor

5: Crankshaft
5*a*: Oil passage
5*b*: Eccentric pin
5*c*: Counterweight
5*d*: Propeller
6: Cylinder
6': Compression chamber
7: Piston
8: Connecting rod
9: Valve assembly
10: Cylinder head
11: Suction muffler
12: Suction pipe
13: Discharge pipe
20: Piston
22: Connecting chamber
24: Interference preventive portion
26: Caulking portions
30: Piston pin
40: Connecting rod
42: Crankshaft connecting portion
44: Piston connecting portion

The invention claimed is:

1. A mounting structure for a piston pin of a hermetic compressor, comprising:

a connecting rod coupled to a crankshaft;

a piston which linearly reciprocates in response to a rotational motion of the crankshaft transferred through the connecting rod, wherein the piston includes a connecting chamber formed as an opening at a trailing end of the piston;

a piston pin configured to couple the piston to the connecting rod; and at least one caulking portion provided in the connecting chamber, wherein the at least one caulking portion comprises a structure which extends outward from an inner surface of the connecting chamber and is configured to at least partially encircle an external surface of the piston pin so as to couple the piston pin and the piston.

2. The mounting structure as claimed in claim 1, wherein the at least one caulking portion is configured to protrude from the piston from its position within the connecting chamber, and wherein the at least one caulking portion is positioned at at least one of locations in the connecting chamber corresponding to upper and lower ends of the piston pin.

3. The mounting structure as claimed in claim 2, wherein the structure of the at least one caulking portion comprises a pair of opposing extended portions which extend in a longitudinal direction of the piston and are configured to come into close contact with an external surface of the piston pin so as to fix the piston pin into the piston.

4. The mounting structure as claimed in claim 3, wherein the pair of opposing extended portions extend outward from a transverse surface of the connecting chamber in a longitudinal direction of the piston.

5. The mounting structure as claimed in claim 3, wherein the pair of opposing extended portions are spaced apart a distance which is greater than or equal to a diameter of the piston pin.

6. The mounting structure as claimed in claim 5, wherein the space formed between the pair of opposing prongs is configured to receive the piston pin.

7. The mounting structure as claimed in claim 3, wherein the pair of opposing extended portions are configured to deform when subjected to plastic deformation so as to encircle an external surface of the piston pin.

8. The mounting structure as claimed in claim 2, further comprising an interference preventive portion formed as a recess adjacent the connecting chamber.

9. The mounting structure as claimed in claim 8, wherein the interference preventive portion is configured to prevent interference between the piston and the connecting rod when the piston pin and connecting rod are installed in the connecting chamber.

10. The mounting structure as claimed in claim 1, wherein end portions of the at least one caulking portion are configured to deform when the at least one caulking portion is subjected to plastic deformation so as to at least partially encircle an external surface of the piston pin.

11. The mounting structure as claimed in claim 1, wherein the piston pin is configured to be slidably engaged with the connecting rod, and the connecting chamber is configured to receive the engaged piston pin and connecting rod therein.

12. The mounting structure as claimed in claim 1, wherein the at least one caulking portion comprises a pair of caulking portions positioned at opposite ends of the connecting chamber.

13. The mounting structure as claimed in claim 12, wherein the opposite ends of the connecting chamber at which the pair of caulking portions are positioned correspond to opposite ends of the piston pin.

14. The mounting structure as claimed in claim 13, further comprising an interference preventive portion formed as a recess extending between the pair of caulking portions and adjacent the connecting chamber.

15. The mounting structure as claimed in claim 14, wherein the interference preventive portion is configured to prevent interference between the piston and the connecting rod when the piston pin and connecting rod are installed in the connecting chamber.

16. The mounting structure as claimed in claim 1, wherein the at least one caulking portion extends outward from an inner transverse surface of the connecting chamber.

17. A connecting structure for a hermetic compressor, comprising:

a crankshaft;

a piston; and a connecting rod coupled to the crankshaft and the piston, wherein the connecting rod is coupled to the piston using a pin and a structure which extends outward in a longitudinal direction of the piston to receive the pin such that the pin and the piston are coupled.

18. The structure of claim 17, wherein the structure comprises a pair of opposing extended portions configured to at least partially encircle an external surface of the pin so as to couple the pin and the piston.

19. The structure of claim 18, wherein the pair of opposing extended portions are configured to deform so as to at least partially encircle an external surface of the pin when they are subjected to plastic deformation.

20. The structure of claim 18, wherein the pair of opposing extended portions are spaced apart a distance which is greater than or equal to a diameter of the pin.

21. The structure of claim 17, further comprising a chamber formed at an end portion of the piston, wherein the structure is positioned in the chamber.

22. The structure of claim 21, wherein the structure extends outward from an inner transverse surface of the chamber.

23. The structure of claim 22, wherein the structure is configured to engage the pin so as to couple the pin and the piston.

24. The structure of claim 21, wherein the structure comprises a first and second portions positioned at opposite ends of the chamber.

25. The structure of claim 24, wherein the opposite ends of the chamber at which the first and second portions are positioned correspond to opposite ends of the pin.

26. The structure of claim 21, wherein the chamber is formed as an opening in a rear end portion of the piston.

* * * * *